United States Patent [19]

Paccione et al.

[11] 4,064,800

[45] Dec. 27, 1977

[54] PRINTER DEVICE USING TIME SHARED HAMMERS

[75] Inventors: Sebastian W. Paccione, Norristown; Theodore J. Risnychok, Blue Bell, both of Pa.

[73] Assignee: Sperry Rand Corporation, New York, N.Y.

[21] Appl. No.: 662,799

[22] Filed: Mar. 1, 1976

[51] Int. Cl.[2] ..... B41J 1/20

[52] U.S. Cl. ..... 101/93.14; 101/111; 197/1 R; 101/93.09

[58] Field of Search ..... 101/426, 93.01, 93.13, 101/93.09, 93.14, 93.15, 93.16, 93.17, 110, 111; 197/1 R

[56] References Cited

U.S. PATENT DOCUMENTS

| | | | |
|---|---|---|---|
| Re. 26,240 | 7/1967 | Wasserman | 101/93.09 |
| 3,332,343 | 7/1967 | Sims | 101/93.16 |
| 3,433,153 | 3/1969 | Harrington et al. | 101/93.13 X |
| 3,623,427 | 11/1971 | Buehrmann et al. | 101/93.14 |
| 3,672,297 | 6/1972 | Berglund et al. | 101/93.09 |
| 3,734,012 | 5/1973 | Huggins | 101/93.16 |
| 3,789,969 | 2/1974 | Howard et al. | 197/1 R |
| 3,858,703 | 1/1975 | Duley | 197/1 R |
| 3,899,968 | 8/1975 | McDevitt | 101/93.14 X |

*Primary Examiner*—Edward M. Coven
*Attorney, Agent, or Firm*—Rene A. Kuypers

[57] ABSTRACT

There is disclosed a low to medium speed printer for use with a digital computer that is characterized by improved throughput, low cost and flexibility. These characteristics are achieved by the fact that it prints in either direction, that several print actuators are time shared among the various print columns of the paper and the print actuators can be readily added to or subtracted from depending on the performance per cost objectives desired.

1 Claim, 15 Drawing Figures

(a.)
(b.)
STEP MOTOR
11
BARREL CAM
12
13
28
22
23
20
PRINT HAMMER, 14
10
18
17
15
16
21
PRINT BAND, 19

24
26
25
19
COLUMN #
1 2 3 4 5 6 7 8 9 10 11 12 13 14 15 16 17 18 19 20 21 22 23 24 25 26 27 28 29 30 31 32 33
A B C D E F G H I J K L M #
27
HAMMER MOTION
$14_1$
$14_2$
$14_3$
$14_4$

PRINTER DEVICE USING TIME SHARED HAMMERS

BACKGROUND OF THE INVENTION

1. Field of the Invention

This invention relates in general to the field of printer devices, and in particular, to printer devices which allows individual hammers to print in more than one column.

2. Description of the Prior Art

Printers of the prior art which are used with digital computers are generally of the high speed type wherein a line of print is accomplished by a nearly simultaneous impacting at various print positions along the print line to eventually form a complete line of data. This is accomplished by positioning a plurality of stationary print hammers, which are arranged to be uniformly spaced so that one hammer occupies each print position along the print line, and the hammers are aligned in a single row to the print line.

Another type of printer known to the prior art and which is of the low speed type utilizes a single rotating font wheel which prints in a serial fashion as it continuously translates in a direction across the paper. The font wheel has a plurality of character types arranged in the form of a helix around its periphery and a print hammer is disposed behind the paper and ribbon for impacting at selected times to cause printing of selected characters. This type of prior art printer is considered a low speed type since it prints in a serial fashion one character at a time to form a complete line of data.

Another type of printer of the prior art utilizes a rotating font drum whose length is approximately equal to the width of the paper. Stationary hammer assemblies are located in front of the drum for impacting against the paper and ribbon at selected times.

SUMMARY OF THE INVENTION

The invention comprises a printer device which utilizes a barrel cam to automatically shuttle print hammers back and forth in a linear fashion across the paper and ribbon and in front of a rotating print band so that there is a time-sharing (i.e., to print in more than one column) of the print hammers.

For a given print band speed, the through-put of the printer is related to the number of print hammers and the barrel cam stroke. The fewer hammers that are used (i.e., the greater time-sharing), the larger the stroke but the lower the through-put and cost.

The more hammers that are used (i.e., the less time-sharing) the smaller the stroke and the higher through-put and cost.

The ease with which these parameters can be varied is an advantage in the instant invention since it allows for a family of devices having different characteristics but without a large investment of design and multiplicity of parts.

DESCRIPTION OF THE PREFERRED EMBODIMENTS

Figures 1, 2:
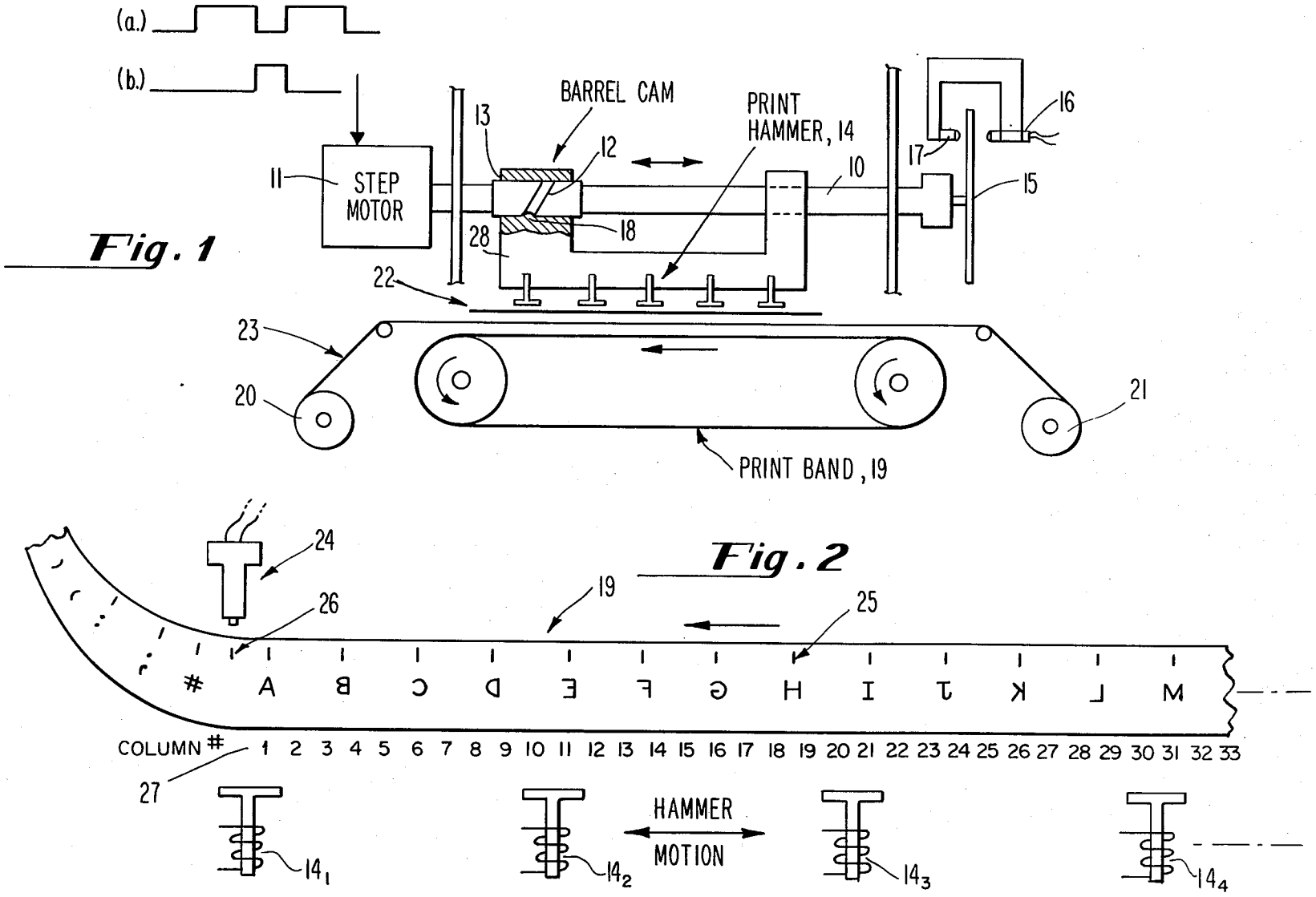
FIG. 1 represents an overall view of the main structure utilized with the present invention.
FIG. 2 illustrates the relationship between the rotating print band and the position of several hammers.

Referring now to FIG. 1 in greater detail there is depicted the mechanical portion of the printer device comprising the barrel cam 13, which is attached to and rotates with the rotating shaft 10. A groove 12 is formed in the barrel cam 13 which is adapted to receive a follower 18, which is an integral part of the actuator and hammer carriage 28. Connected to the shaft 10 is the D.C. stepper motor 11 which causes the shaft 10 to rotate in a clockwise or counterclockwise direction. Thus the barrel cam 13 and follower 18 does, in an uncomplicated manner, translate the rotary motion of the shaft 10 to a linear back and forth motion of the actuator and hammer carriage 28. In other words, as the barrel cam 13 rotates 180°, the follower 18 will be translated a distance in one direction equal to the projection of the groove 18 upon the horizontal. This distance is called the stroke length and will be discussed in greater detail hereinafter. The rotation of the barrel cam 13 an additional 180° causes the follower 18 to be translated in the reverse direction the same distance. This linear translation allows individual print hammers 14 to be time-shared, that is, to print in more than one column of the paper 22 as they oscillate from left-to-right and vice-versa. Only five hammers are shown fixed to the yoke, but it should be understood that any number may be utilized and in a preferred embodiment 12 are attached thereto.

Opposite the barrel cam and hammer assembly is the print band 19 which is designed to be translated from right to left in front of the hammers by means of two counterclockwise rotating members, which are driven by well-known means. Interpositioned between the print or character band 19 and the barrel and print hammer assembly is the paper 22 and the inking ribbon 23, which is located upon the rotating cylinders 20, 21. The paper 22, which is positioned upon tractors (not shown), moves upward out of the plane of the drawing in a well-known manner as the lines of recorded data are generated and printed.

Located upon the shaft 10 is the aperture disk 15 which allows the photocell 17 and lamp 16 to detect hammer position and direction. This will be discussed in greater detail in later paragraphs. The photocell 17 and the lamp 16 are positioned in a facing relationship upon the U-shaped yoke so that the light emanating from lamp 16 can impinge upon photocell 17 as the perforated disk 15 rotates.

Referring now to FIG. 2, there is depicted the print band 19 used in conjunction with the print hammers and drive coils $14_1$ to $14_{12}$. Only coils 14, to $14_4$ are depicted for convenience. As above stated the print band 19 moves from right to left or counterclockwise whereas the hammers $14_1$ to $14_4$ move in either direction. On the print band 19 there is shown embossed characters and embossed sprockets, which are positioned above each character. There is a unique sprocket 26 positioned before the character A which is used to detect true character position and enables synchronization of the logic to take place. This unique sprocket 26 is positioned half way between a normal distance between two characters namely, the last and first characters on the band.

A reluctance pickup 24 detects sprockets and generates sprocket signals therefrom which are utilized throughout the logic as will be discussed hereinafter. There is designated below the print band 19 the numbered columns 27 of the paper 22 (FIG. 1) at which a character will be printed. In the instant embodiment, a line on the paper 22 will be comprised of 120 character positions and there will be 64 characters located on the print band 19.

Figure 3:
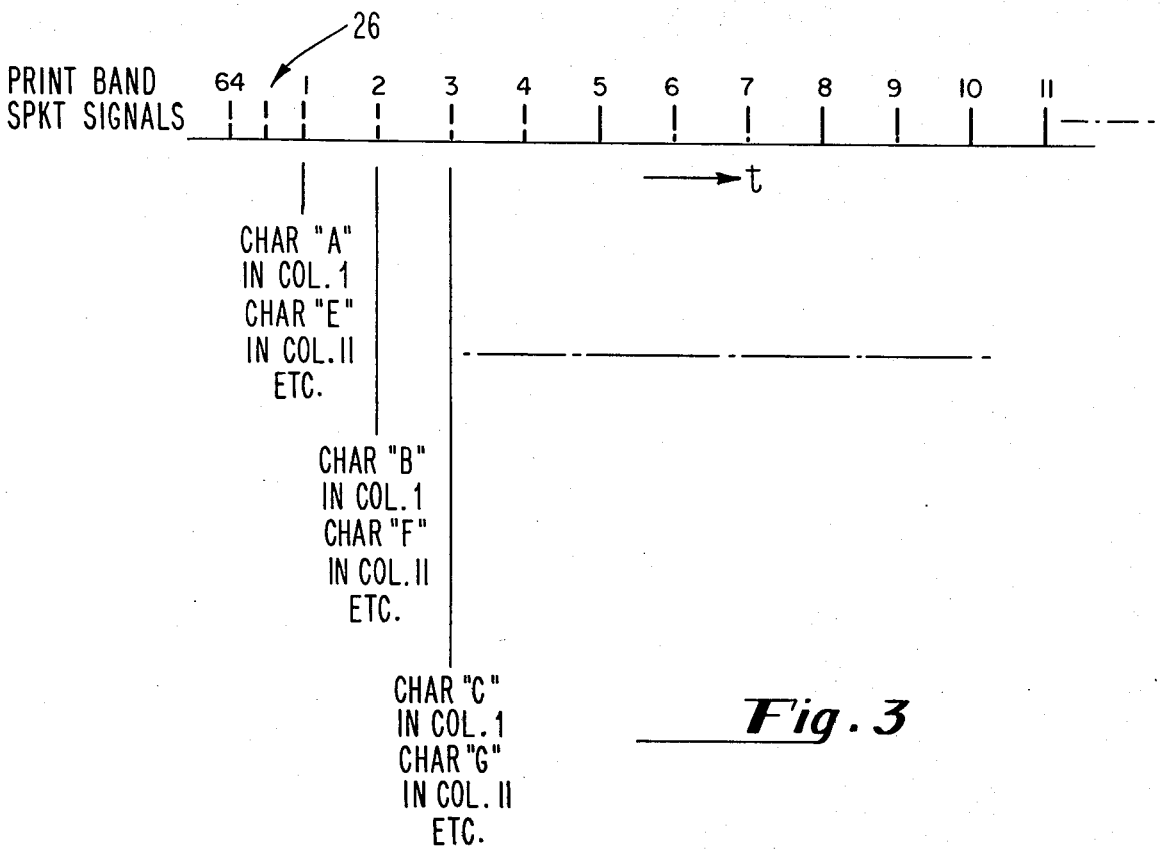
FIG. 3 depicts the relationship of the unique sprocket signal relative to the regular sprocket signals produced by the rotating print band.

Referring now to FIG. 3, there is shown the print band sprocket pulses detected by the reluctance pick-up 24 (FIG. 2), and some of the characters positions associated therewith. The unique sprocket 26 is shown between sprockets 64 and the first sprocket. Accordingly, if character A is located in column 1 then character E would be located in column 11 (see FIG. 2). In like manner, were character B located in column 1, then character F would be positioned in column 11. It can be appreciated therefore that in the instant embodiment where 12 hammers are utilized, 12 characters on the print band would be positioned for possible printing of the print line per sprocket pulse.

There is shown in FIG. 2 hammer $14_1$ being shared between ten columns, that is, hammer $14_1$ as it moves from left to right will print columns 1 through 10, hammer $14_2$ will print columns 11 through 20, etc. In like manner when hammer $14_1$ moves from right to left it will print columns 10 through 1, and print hammer $14_2$ will print columns 20 through 11 etc.. As mentioned above, the number of columns shared can be varied depending on the performance per cost objectives desired.

Figure 4:
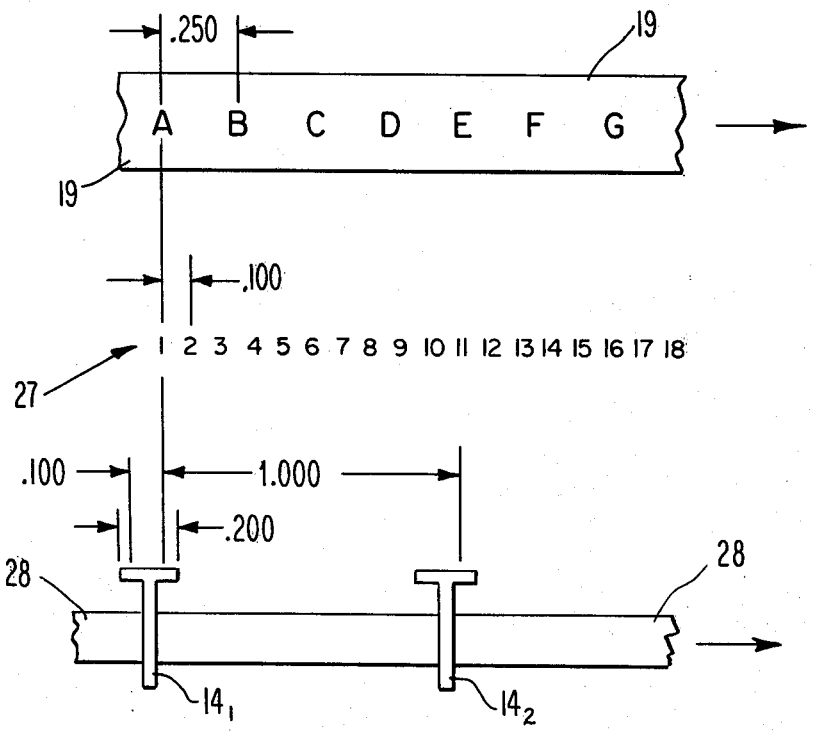
FIG. 4 shows the dimensional relationship between the hammer, paper columns and print band utilized in this invention.

Referring now to FIG. 4 there is shown the dimensional relationship in the present embodiment between the print hammers 14 which are positioned on the translating carriage or yoke 28 with respect to the character band 19 and the printed columns 27. As can be seen each print hammer 14 is approximately 0.2 inches wide and the printer is designed to print characters on 0.1 inch column centers. The distance between characters on the print band 19 is 0.250 inches. Therefore, during each 0.1 inch of travel of the carriage 28 each hammer will have been in position to print one column. An entire line will be printed on the paper 22 when the carriage 28 (FIG. 1) has completed a stroke in either the left-to-right or right-to-left direction. As will be recalled a stroke is generated by a rotation of 180° of the barrel cam 13. It will be recalled that since printing can take place with the hammers moving in either direction, there is a great improvement of printing efficiency over systems which require a non-printing return. The timing of the system is such that a complete font on the print band 19 will pass a column position in less time that it takes the carriage to move 0.1 inch. This insures that any characters in the font can be printed in any column position.

As an example to those skilled in the art of the versatility of the instant invention there is listed below for a printer device of the type under discussion and having a band speed of 235 inches per second for a 132 column nominal printer the following characteristics:

TABLE

| No. of hammers | Stroke length (inches) | Through-put (Lines per Minute |
|---|---|---|
| 12 | 1.10 | 83 at 48 char/band |
| 15 | 0.90 | 100 " |
| 19 | 0.70 | 125 " |
| 33 | 0.40 | 204 " |

It therefore can be seen from the Table that for a given band speed, the through-put of the printer is related to the number of the print hammers and barrel cam stroke.

Figure 5:
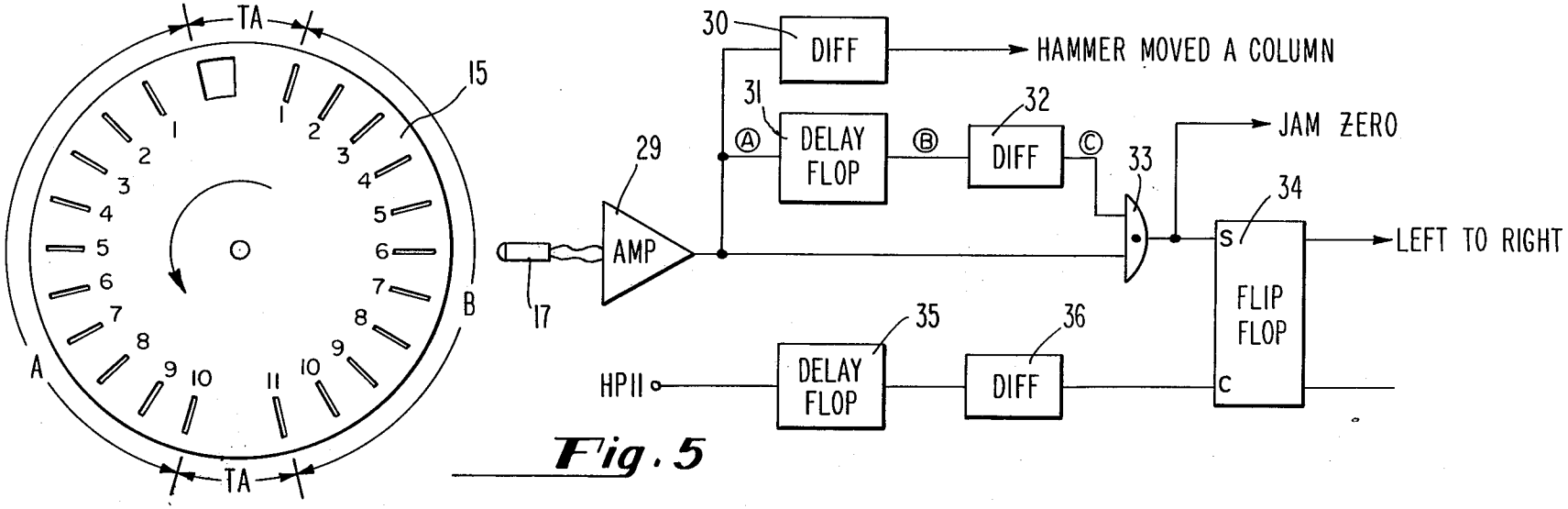
FIG. 5 illustrates the logic circuitry which is utilized with the rotating disk.
Figure 7:
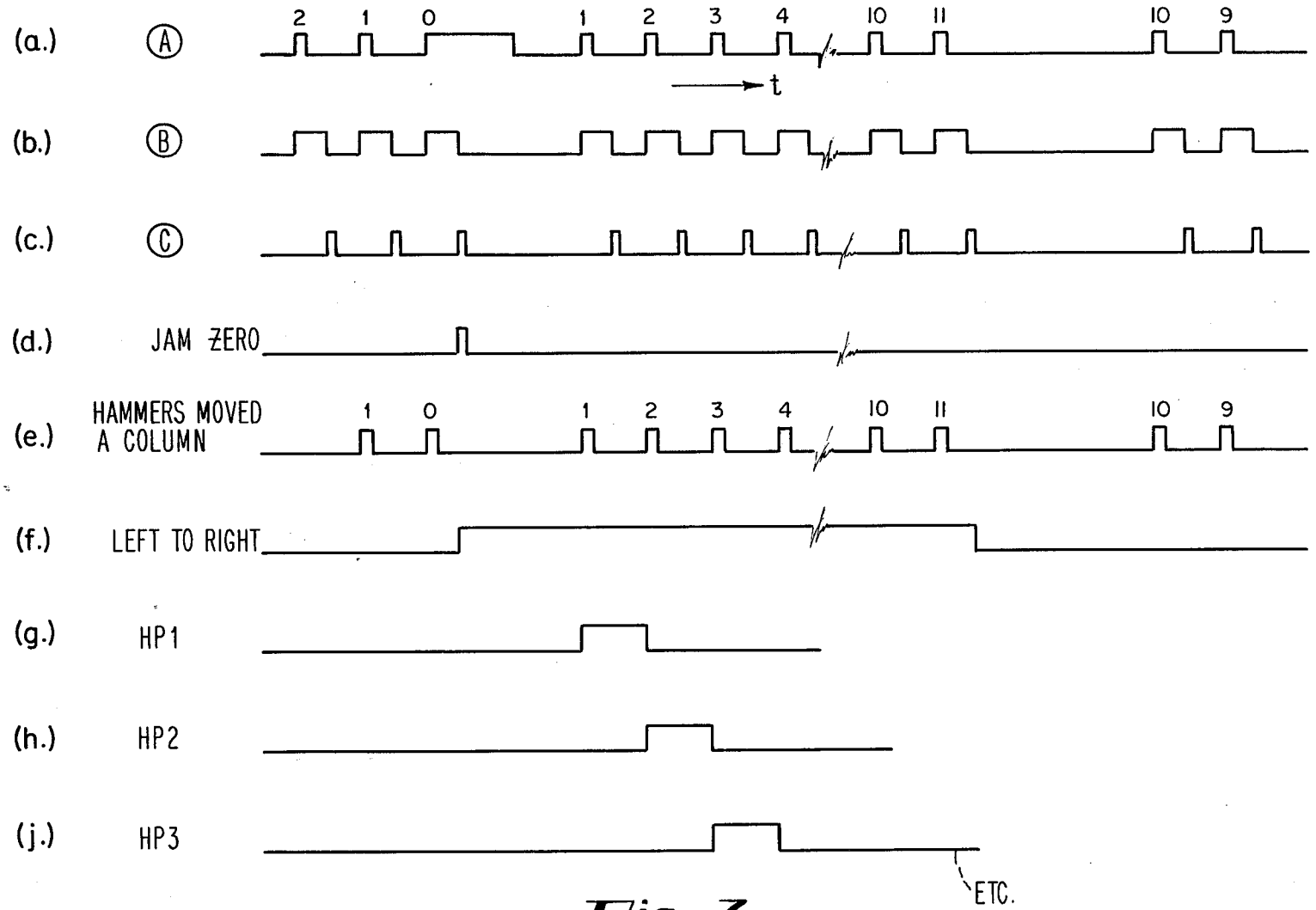
FIG. 7 shows the time relationship which is utilized with FIGS. 5 and 6.

Turning now to FIG. 5 there is shown in greater detail the aperture disk 15 together with the electronics utilized therewith to generate various electronic signals which are used in the operation of the printer logic. As previously mentioned the aperture disk 15 rotates between the photocell 17 and the lamp 16 (FIG. 1). The aperture or coded disk 15 is arranged in the manner shown so that light rays from lamp 16 (see FIG. 1) can shine through the perforations 1–10, which is formed around the A sector of the disk and the apertures 1–11 formed along the B sector thereof. The space between the apertures mentioned and located along the two sectors of the disk identified as TA (turn-around) are formed for the purpose of allowing the print hammers 14 (FIGS. 1,2) to change direction from left to right and vice versa. As is understood, the light rays can pass through the various apertures and impinge upon the photocell 17. After impinging upon the photocell 17 the signal is increased by amplifier 29 (signal A, see FIG. 7*a*) from whence it fans out to the differentiator 30, the delay flop 31 and one input to the AND gate 33.

It should be noted that everytime the aperture disk 15 moves from one opening to an adjacent opening on sectors A or B, it indicates that each of the hammers $14_1$–$14_4$ (FIG. 1) has moved one column position 27 (FIG. 2) on the paper 22 (FIG. 1). This movement of the hammers one column position is noted by the differentiated output of the signal A emanating from the differentiator 30 (FIG. 7*e*). It should further be noted in FIG. 7*a* that the counterclockwise rotation of aperture disk 15 has started, by way of example, with aperture 2 and 1 of sector A passing the photocell 17. The zero in FIG. 7*a* is developed by the large aperture in upper sector TA and the pulses begin again with aperture 1 to 11 of Sector B. The large separation of lower sector TA between openings 11 and 10 of the disk 15 is also shown by the non-signal between pulses 11 and 10 since there is no opening thereat.

The first input to the AND gate 33 is obtained by feeding the signal A into the delay flop 31 where it is outputted as signal B (FIG. 7*b*) and then acted upon by the differentiator 32 (FIG. 7*c*). The output of the differentiator is applied as the second signal to the AND gate 33. The first input to the AND gate 33 is signal A (FIG. 7*a*) as above mentioned. When these two signals are both applied to the AND gate 33, it is permissed and its output is designated as the jam zero signal (FIG. 7*d*) whose purpose will be discussed in a later paragraph. In other words the large opening in the aperture disk 15 located at the upper sector T.A. is utilized to form the jam zero signal. This signal will be discussed with respect to FIG. 6.

When the output of the AND gate 33 is generated it is also applied to the set input terminal of the flip-flop 34. The flip-flop 34 therefore produces the HIGH left to right signal (FIG. 7*f*), which indicates that the hammers 14 (FIG. 1) are moving in a left to right direction. The flip-flop 34 will be reset by the signal HP 11. This signal originates with opening 11 of the sector B of the disk 15 and will be discussed imimmediately below.

Figure 6:
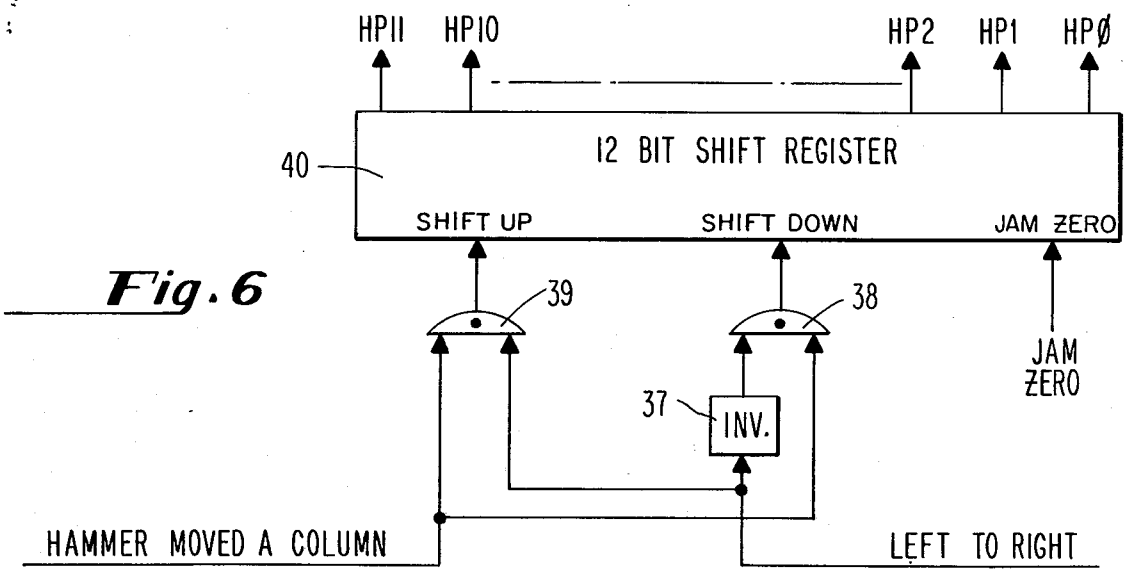
FIG. 6 depicts the logic circuitry utilized with the shift register for determining hammer position.

The three signals above generated, namely, "hammer moved a column," "jam zero" and "left to right" are applied to the 12 bit shift register 40 of FIG. 6. The jam zero signal is utilized to reset the bit shift register 40 to zero (i.e., HP0) so that it is ready to begin counting either up or down. Since the left to right signal is HIGH (FIG. 7*f*) and the "hammer move a column" signal is also HIGH the AND gate 39 is permissed, the shift register 40 will shift up from HP0 to HP11. The HP 1 signal, for example, shown in FIG. 7*g* designates that the hammers $14_1$ to $14_4$ (FIG. 2) are located respectively with respect to the paper 22 in columns 1, 11, 21, etc. In other words, the HP1 signal designates that the hammers are in position to print columns 1, 11, 21, etc. provided that the desired characters of the print band 19 are located in these same columns. The The HP 2–10 signals generated by register 40 also indicate that the hammers are moving from column to column which will be discussed in great detail hereinafter with respect to FIG. 8. The HP11 signal produced by shift register 40 is utilized as an input to the delay flop 35 (FIg. 5). It is differentiated by the circuit 36 and is used to reset the flip-flop 34 (FIg. 7*f*).

When the hammers are moving in the reverse direction, that is, from right to left, the left to right signal will be LOW (i.e., after the 11th "hammer moved a column" signal is generated). This signal is inverted by the inverter 37 which causes it to go HIGH. In addition, the photocell 17 will have the perforations of sector A beginning with perforation 10, 9, 8 etc. moving before it. Therefore, in shifting down both inputs to the AND gate 38 will be HIGH which will cause the shift register 40 to count from HP10 to HP0.

Figure 8:
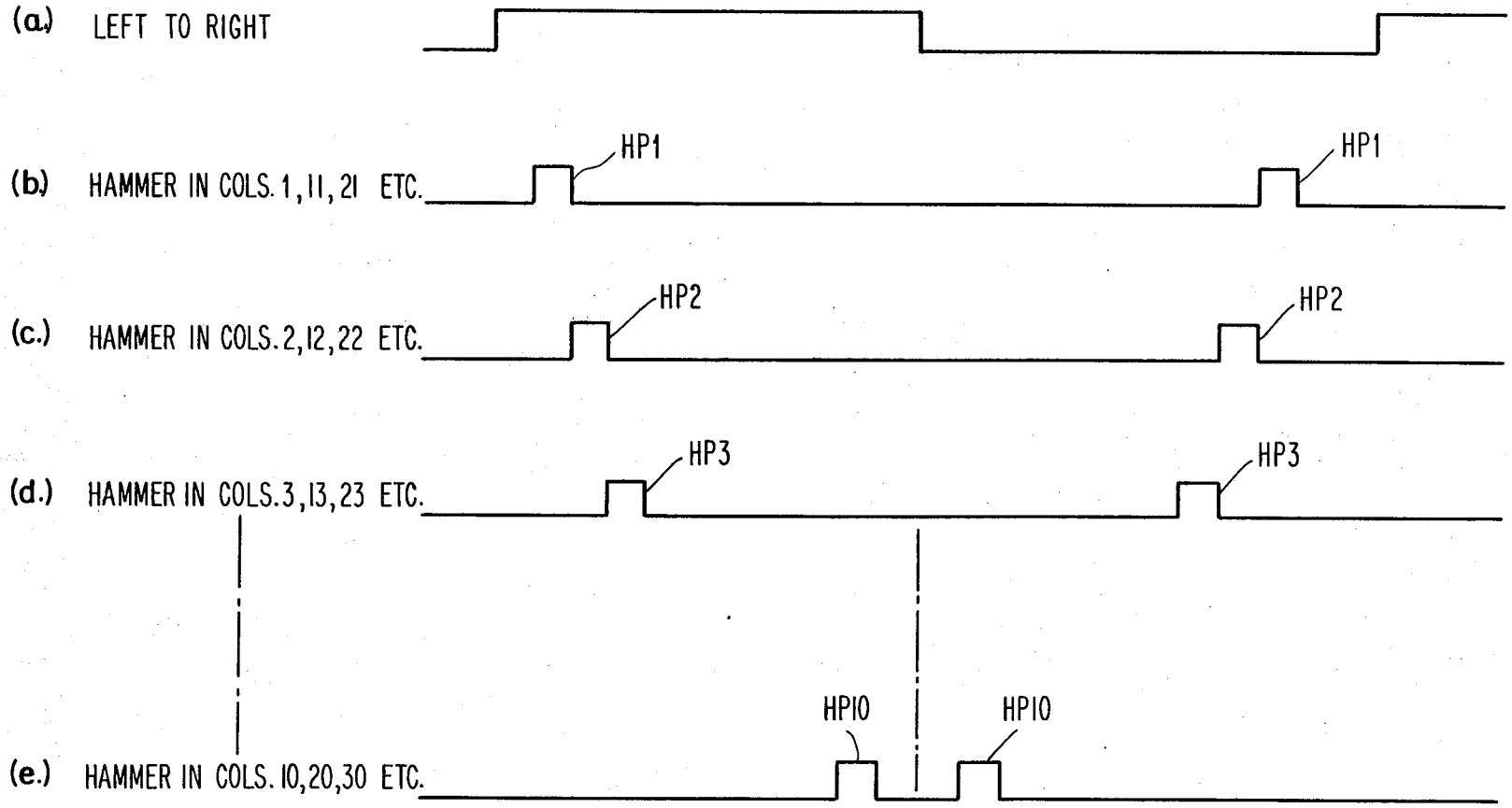
FIG. 8 illustrates the timing relationship between the hammer position with respect to the direction of travel of the hammer carriage.

Reference is now made to FIG. 8 wherein an expanded view of the signals developed by FIG. 6 is shown. FIG. 8*a* depicts the "left to right" signal and is identical to FIG. 7*f*. In FIGS. 8*b, c, d* and *e*, there is shown the pulses which are consecutively generated by the shift register 40 and indicate that the hammers $14_1$–$14_{12}$ are located in front of a particular column position. For example, in FIG. 8*b*, the signal HP 1 indicates that the hammer $14_1$, is in front of column 1, the hammer $14_2$ in front of column 11, the hammer $14_3$ in front of column 21, and hammer $14_4$ in front of column 31 etc. Similarly, in FIG. 8*c*, the generated pulse, HP2, indicates that the hammers $14_1$ to $14_4$ are in front of the respective columns 2, 12, 22, 32 etc.. Finally, by generating similar signals (not shown) the signal HP 10 is produced. This indicates that the hammers $14_1$–$14_4$ are located in front of columns 10, 20, 30 etc.. After printing in this column position takes place, the stepper motor 11 stops and the paper feed advances one line. It should be understood by the reader that 120 column printer is under discussion so that there would be 12 hammers each of which are time-shared between ten columns.

When the "left to right signal" in FIG. 8*a* goes to the quiescent state by means of the HP 11 signal (FIG. 7*f*, 8*a*) the hammer translation reverses. Referring to FIG. 8*e*, it can be readily seen that the hammers are again ready to print in columns 10, 20, 30, 40 etc. in view of the generation of the HP 10 signal (FIG. 8*e*). In the manner previously described, FIGS. 8*d, c* and *b* illustrate how the signals HP 3, 2 and 1 are generated in descending order so that line two may be printed. In other words, these signals are utilized to determine hammer position with respect to a column number when the printer is printing in the reverse direction (i.e., right-to-left).

The previous discussions with respect to FIGS. 5, 6, 7 and 8 are related to the position of the hammers with respect to the paper column positions. These hammers are moving from a left-to-right or vice versa relatively slowly with respect to the continuous spinning print band 19 (FIG. 1). This relative speed is such that every one of the characters on the band will pass every column while the hammers have moved only 0.1 inch. In other words, the printer has to be able to print any one of 64 characters in a given column and this is accomplished by the slow relative speed of the hammers with respect to the print band. The independent logic will now be shown and described in FIG. 9 for determining the band character position relative to the print column.

Figure 9:
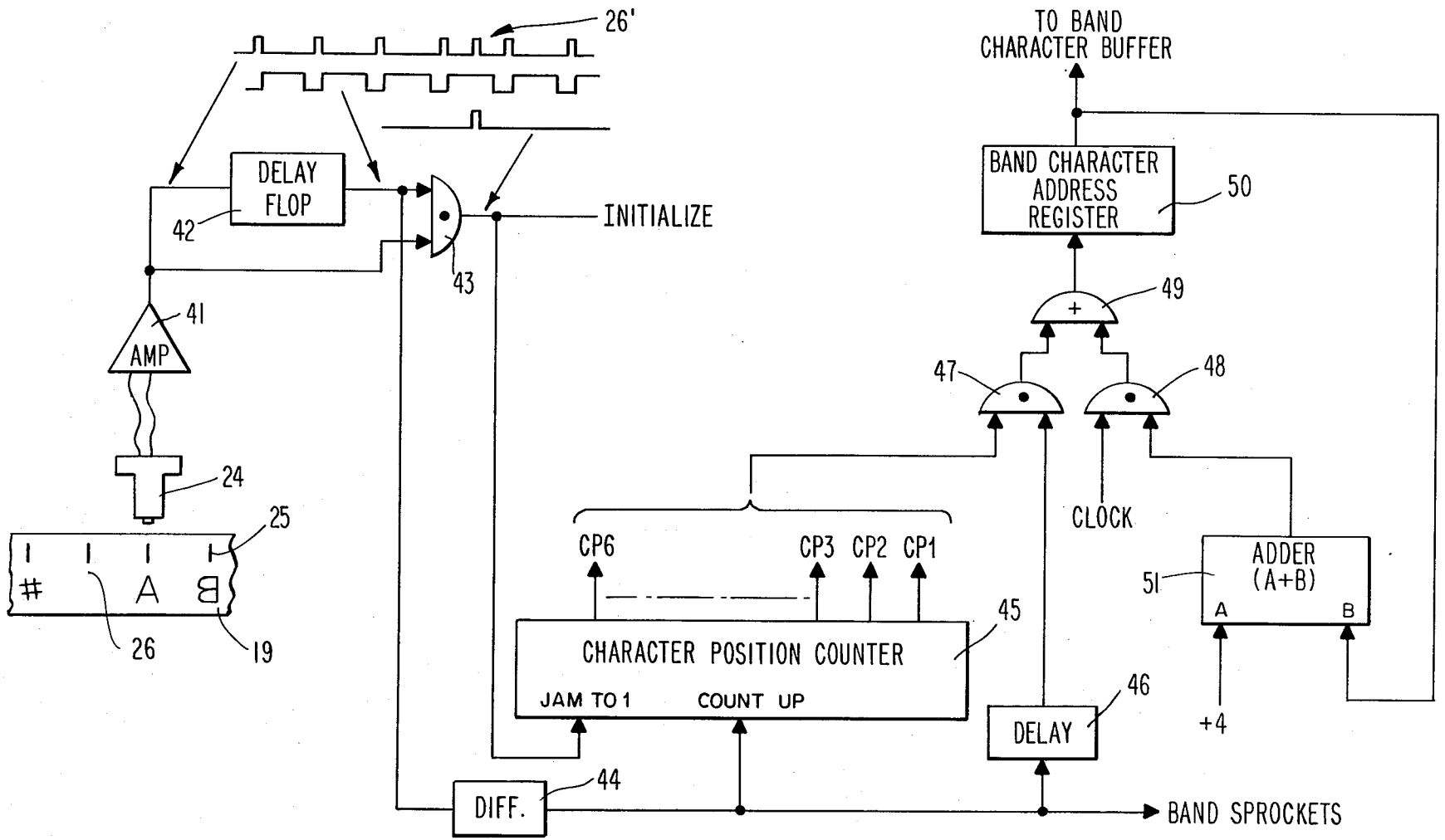
FIG. 9 illustrates the logic utilized to determine the location of the character position on the rotating print band as well as the logic to determine the address in the band character buffer.

FIG. 9 depicts a portion of the print band 19, which includes several sprockets 25, and the unique sprocket 26. Juxtaposed to the sprockets is the reluctance pick-up 24, which generates a pulse each time that a sprocket passes beneath it. A pulse train of sprocket signals is shown emanating from the amplifier 41 which includes the unique sprocket signal 26' located half the distance between two regularly spaced pulses. In other words, the time separation of the unique pulse is one-half that between two sprocket pulses. The amplified sprocket signal train is directed into one input of the AND gate 43.

The sprocket signal train is also directed into the delay flop 42 as shown and thence as a second input to the AND gate 43. It can be readily seen that the AND gate is conditioned during the time that the unique sprocket pulse is generated. The output of the AND gate is fed to the "JAM to 1" terminal of the character position counter 45. The character position counter 45 is a conventional binary counter that can count to a value of $2^6$ or 64 after which it is again jammed to one by the unique sprocket pulse.

After the counter 45 is jammed to 1, it will begin to count in binary fashion by receiving the output from the differentiator 44 which in turn is directed to the "count up" terminal of the counter 45 so that the output terminals CP1–CP6 will represent in binary form a corresponding binary character. For example, the binary signal 000001 may represent the character A. The six signals CP1–CP6 are shown being directed into the AND gate 47. This configuration is for purposes of simplicity only and in reality there would be a total of six AND gates (i.e., one AND gate per CP signal) and each one of the AND gates would be gated individually into a total of six OR gates all of whose output would be gated into the band character address register 50. In reality therefore, the signal CP1 only would be directed into the AND gate 47 together with the output of the delay circuit 46. The delay circuit 46 is utilized with the CP signals because it takes a finite time for the counter to settle every time it changes the count by means of the CP signals. Therefore, the delay 46 may be between 200–500 nanoseconds which is sufficient time for the counter to settle. It should be understood that this delay signal would be applied to the other AND gates which are not shown.

Therefore, the AND gate 47 together with the other five AND gates which are not shown are permissed if a binary "1" is present at their corresponding CP1-6 outputs along with a pulse from delay 16. If a binary "0" is present at any of the CP outputs no signal appears at the output of its corresponding AND gate. By way of example, let us show what occurs when the letter A is the character on the rotating band 19 in column 1 of the paper. Since there is only one pulse that has been counted after the "jam to 1" signal has occurred, the counter will read from CP6–CP1, 000001. Assuming that the AND gate 47 is connected to the output CP1, it will be conditioned, whereas the five remaining (not-shown) AND gates will not be conditioned because the remainder of the code is all 0's. Accordingly, the OR gates will be conditioned whereas the remaining five (not shown) OR gates will not be conditioned. Therefore, the signal inputted to the band character address register 50 will be 000001. This code will represent the address of the letter A, which is positioned at column 1 of the paper in the band character buffer which will be discussed hereinafter. It should be noted hereat that it has been determined that character A of the rapidly rotating band 19 is located at column position 1. It should be understood that any one of the 64 characters passes by column 1 so that the counter counts to 64 which represents any of the remaining characters before it is reset again by the "jam to 1" signal.

Referring again to FIGS. 1 and 2 it can be appreciated that certain characters are in front of the remaining hammers $14_2$–$14_4$ (actually in front of 12 hammers). For example, FIG. 2 shows that character E is in front of hammer $14_2$, character I is in front of hammer $14_3$ and character M is in front of hammer $14_4$ etc.

The logic of FIG. 9 is able to determine the above band character positions with respect to column location in the following manner. Between sprocket signals, a clock pulse is used to increment the contents of the band character address register by 4 via the adder 51. Therefore, by adding a binary 4 to the binary 1, the result is a binary 5. This indicates that the character E is "4 up" from character A and is in column 11 and in front of hammer $14_2$, character I is "4 up" from character E in column 21 and is in front of hammer $14_3$ and character M is "4 up" from character I and is in front of column 31 etc..

The above incrementation is done under the control of the clock pulse, which is much faster than the character band rotation. Therefore, scanning may be accomplished very quickly before a band sprocket has hardly moved on the print band 19.

In review, it is now known where the print hammers are located with respect to a column position because of the generating of the HP signals, and further it is known where the characters on the rotating print band are relative to the column position in view of the CP signals. It is now required to determine when the print hammer should be fired in order to print a character in the required column.

Figure 10:
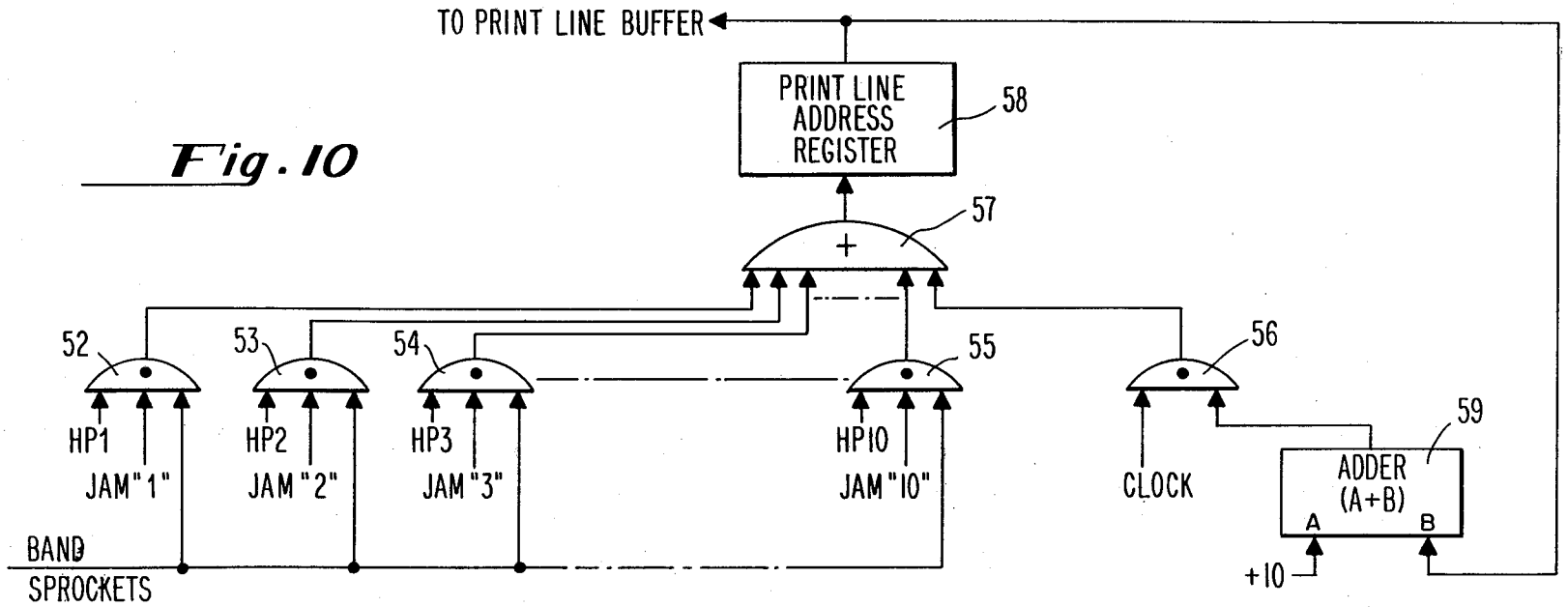
FIG. 10 depicts the logic circuitry utilized for determining the address in the print line buffer, which contains the characters of the line to be printed.

Referring now to FIG. 10, there is depicted the logic circuitry required to determine an address in the print line buffer. Assume for purposes of discussion that the printer is printing from left to right and the signal HP 1 is generated by register 40 (FIG. 6) so that the hammers are in front of columns 1, 11, 21, 31 etc. This HP 1 signal is applied to the AND gate 52. A second signal applied to the AND gate 52 is a band sprocket pulse. The third signal inputted to the AND gate 52 is the "jam 1" signal. The jamming signal is produced by a register (not shown) that has a group of coupled gates connected to its input circuitry. The output of the register produces a binary signal corresponding to the number jammed, e.g. 0000001. Therefore, with these three signals present the AND gate is permissed after which it is OR'ed by the gate 57.

The output of the OR gate 57 is applied to the Print Line Address Register 58 in order to generate an address therein. This address will be used to pull out the proper code for the character in column 1 as will be discussed later.

One address is generated for every HP signal only one such signal is generated at a time. Since the HP 1 signal indicated that the hammer was located in column 1 of the paper, the clock signal will cause the number stored in the Print Line Address Register 58 (in our example, 0000001) to be incremented by 10 via the terminal A of the adder 59. Terminal B receives the feedback signal, that is, the existing address, from the output of the print line address register 58. Ten is added to the existing address since the next hammer position is located ten column positions from the first column position. Therefore, the address will be generated by the Print Line Address Register 58 for the character 10 columns removed from the first column position. This incrementation by ten is repeated for the 12 hammers in the embodiment under consideration. It should be apparent that the operation which was described with respect to columns 1, 11, 21, 31 etc. was operating in like fashion with the remaining columns. It should further be recalled that since the clock pulse is so rapid with respect to the band rotation or hammer movement, all addresses for the 12 characters are determined before there is any significant relative movement of the band or hammers.

The above discussed counting required to generate the address of the character in a certain column position is occurring simultaneously with the address that is being generated by the band character address register 50. This is significant in determining when the hammers $14_1$–$14_4$ are to be fired for printing.

Figure 11:
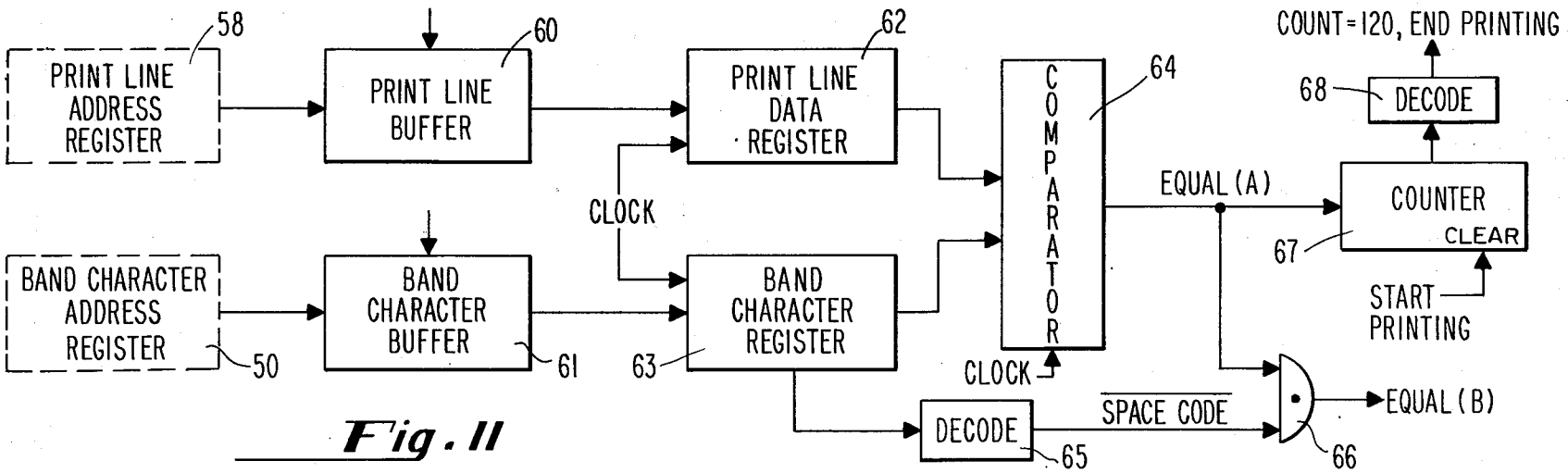
FIG. 11 shows the logic compare circuitry which is utilized to determine whether a hammer should be fired for printing a particular character.

The Print Line Address Register 58 and the Band Character Address Register 50 are shown in dotted outline form in FIG. 11. The Print Line Address Register 58 is connected to the Print Line Buffer 60, whereas the Band Character Register 50 is connected to the Band Character Buffer 61. The Print Line Buffer 60 is a memory device which at the start of each new line it is loaded with the codes corresponding to the characters that it is desired to print for a line. For example, the code utilized could be a seven bit ASCII code. This loading operation is shown on FIG. 11 by the input line connected to the print line and band character buffers 60, 61 and is generated by the processor of the computer (not shown). It should be noted that each code is specified with an address location. Similarly, the Band Character Buffer 61 is also loaded whenever a print band 19 is put into the printer. The sequence of character codes loaded into this memory buffer corresponds exactly to the physical sequence of the 64 characters on the band 19 and is located in the buffer by an address location. In the present embodiment the first character is an A and ends with the number sign character (#) see (FIG. 2).

Continuing with our example, the rotating print band 19 has located the characters A, E, I, M etc. in column positions 1, 11, 21, 31 etc. Similarly, the print hammers $14_1$–$14_4$ are located in juxtaposition to columns 1, 11, 21, 31 etc..

Let us now assume that of the four characters mentioned above, only the Character A is required to be printed in column 1 since the Print Line Buffer 60 has been loaded with this information.

The address generated in the Print Line Address Register 58 will search the Print Line Buffer 60 and cause the binary code of the character A to be pulled out and stored in the Print Line Data Register 62 at a given clock time. Similarly, the address generated by the Band Character Address Register 50 causes the binary code of the band character that is opposite the column position which is stored in the Band Character Buffer 61 to be pulled and stored in the Band Character Register 63.

The binary contents of the register 62, 63 are compared in the comparator 64 and if equal, an equal A pulse is generated. The equal A pulse from the comparator is sent to a counter 67. When 120 equal A pulses or comparisons are generated the decoder 68 will signal an end of printing on this particular line. In this logic arrangement provisions are also made to detect a space code. A space code means that no hammer is fired and therefore a blank is put on the paper. Space codes, however, are counted as columns printed even though there is no hammer firings associated with it.

It is noted that an Equal B pulse is generated when there is no space code signal, $\overline{\text{space code}}$, that is, both inputs to the AND gate 66 are HIGH. However, when a space code is required, an equal B signal is not generated since the $\overline{\text{space code}}$ input is LOW.

In summary, if a space is desired to be printed in a certain column position, a code will be associated therewith. This space will be represented on the print code by a space character or blank etched on the band and will be one of the 64 characters. A compare is obtained in the usual manner in the desired column and an equal A pulse will be generated. This equal A pulse is fed to the counter 67 and will be counted as one of the 120 characters on the line. Since it was decoded by circuit 65 as a space code, the generation of the equal B pulse is inhibited from firing a hammer.

Figure 12:
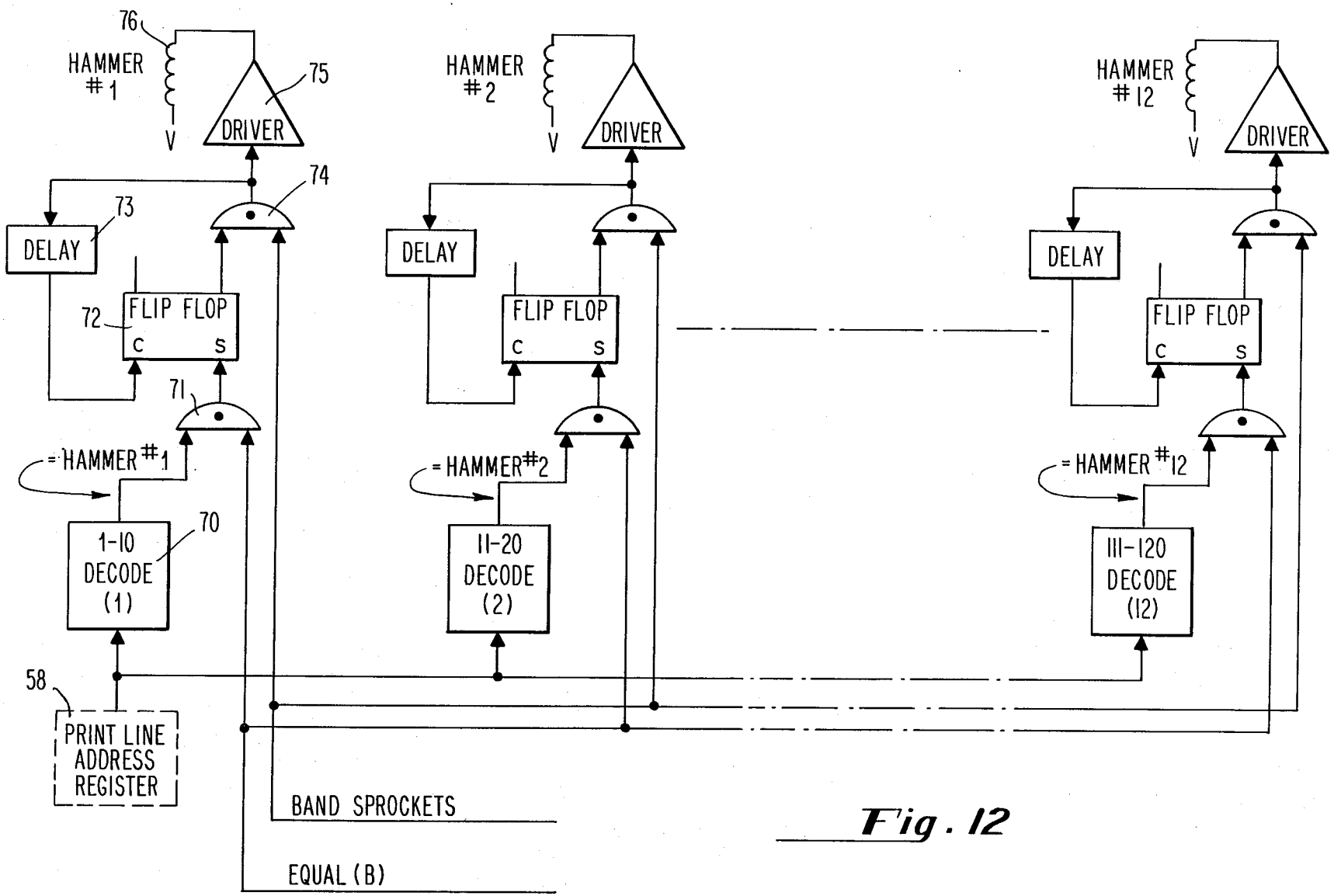
FIG. 12 illustrates the logic and circuitry which is utilized to fire a hammer for printing a character.

Turning now to FIG. 12, there is shown the hammer driver logic. This logic with the exception of the decode block is identical for each hammer. If the Print Line Address Register 58 contains any address between 1 and 10, the hammer #1 array will be energized. It will be recalled in our example that the character A was to be printed in column 1. The code for an A was designated as a binary one (0000001) so that it will be decoded as such by the circuit 70. The output of the decoder 70 will be fed into the AND gate 71 as one HIGH input and the second input is the Equal B pulse, which is HIGH when there is no space code as is the present example.

Therefore, the AND gate 71 will be permissed so that its output will cause the flip-flop 72 to be set. The set flip-flop 72 will cause its output to revert to the HIGH state which will be inputted to the AND gate 74. The second input to the AND gate 74 is the band sprocket pulse 25 (FIG. 1). Therefore, since all conditions are present for firing the hammer 14, which is located opposite column 1, the driver will amplify the AND gate signal to energize the hammer coil 76 by completing the circuit path to the V supply voltage.

In a similar manner, all of the 120 columns will be printed by selectively energizing the twelve hammers until a line is printed.

The flip-flop 72 is reset by feeding back the output signal through a delay circuit 73 and thence to the reset terminal C. The delay circuit insures that the hammer coil receives its required pulse width.

Figure 13:
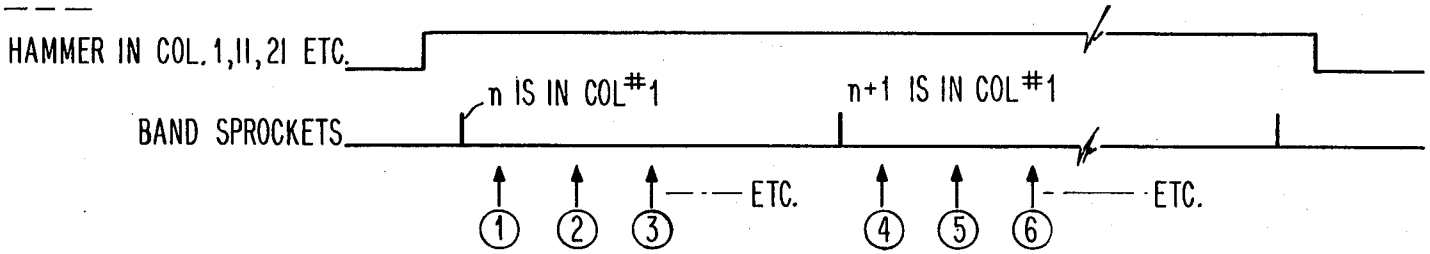
FIG. 13 is a diagram which illustrates in graphic form whether a hammer should be fired to print a character by scanning column positions.

Referring to FIG. 13, there is shown in graphic form whether a hammer should be fired to print a character by scanning column positions. In the upper graph there is shown the HP signal produced by the shift register 40 (FIG. 6). For each HP signal there is shown several of the 64 band sprocket signals included in an HP signal. If it is assumed that the character $n$ is in the first column as shown by the first sprocket, then the character code stored in the print line buffer 60 (FIG. 11) for column 1 will be compared with character $n$ in the band character buffer 61 and if equal, the flip-flop 72 (FIG. 12) will be set; similarly, the character code stored in the print line buffer for column 11 will be compared with character $n+4$, and character code stored for column 21 will be compared with the code for character $n+8$ etc. to determine if the corresponding flip-flop 72 should be set. When all of the 12 character codes have been compared with all of the 12 hammer locations, the next sprocket appears and the same procedure is repeated except that now character $n+1$ appears in column 1 which is compared with the character code stored in the print line buffer for column 1 and if equal, the flip-flop is set. In like manner the character codes stored for columns 1, 11, 21 etc. are respectively compared with characters $n+1+4$, $n+1+8$ etc. and will cause the hammer flip-flop to be set if there is coincidence.

Figure 14:
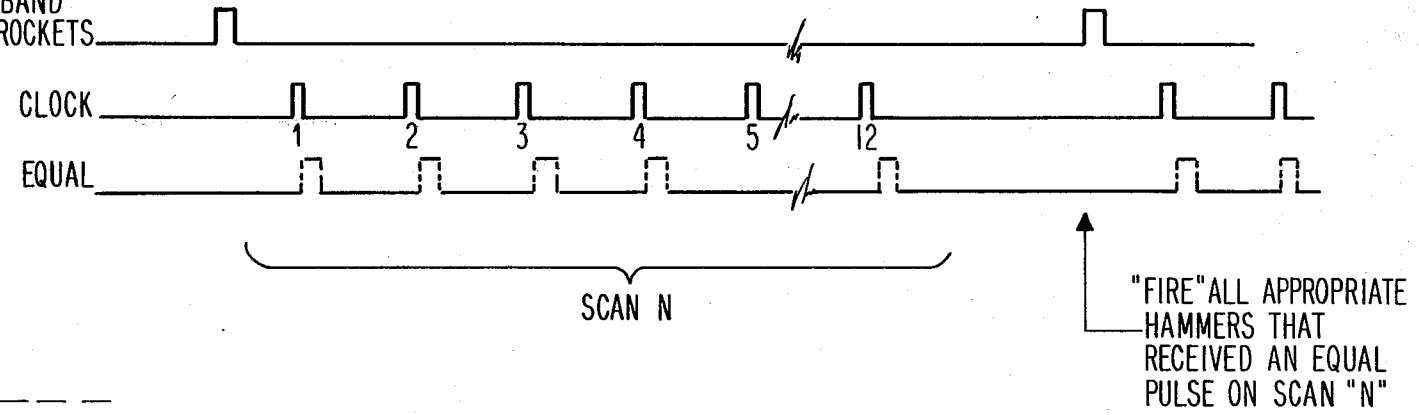
FIG. 14 is a timing diagram which illustrates the relationship between the band sprockets, the clock pulses and the equal pulses for firing appropriate hammers.

FIG. 14 further indicates the overall view of the pulse operation between two consecutive sprockets and the clock pulses 1–12 are shown as existing between the sprockets. Several equal pulses 1–4 and 12 are shown by way of example as being generated indicating that these hammers are "fired" on scan "N." As is understood, other appropriate hammers will be fired on the next scan "N+1."

When the entire line has been printed, the aperture disk 15 (FIG. 5) has rotated counterclockwise so that all of sector B has passed the photocell 17. It will be noted that in sector B there is an additional aperture 11 which will produce an additional signal HP 11 emanating from the 12 bit shift register 40 (FIG. 6). When the signal HP 11 is generated it is applied to the delay flop 35 (FIG. 5) after which it is differentiated by the circuit 36. The output of the differentiator 36 is applied to the C terminal of the flip-flop 34, which is caused to be reset so that no further signals are generated with an upward count (FIGS. 7*a, b, c, e, f*).

As the aperture disk 15 continues to rotate in the counterclockwise direction, the TA sector allows sufficient time for the stepper motor 11 (FIG. 1) to become inactive and allows the paper feed to advance the paper 22 one line. This can be seen in greater detail in FIG. 1. FIG. 1 shows the signal train (*a*) which is applied to the stepper motor 11 during its operation. The first pulse of the train causes the motor 11 to move the barrel cam 13 from left to right ten column positions in order to print one line, whereas the second pulse causes the barrel cam to move from right to left ten column positions when printing the second next line. FIG. (*b*) depicts the signal that represents the time period that the stepper motor is inactive and the paper feed time is active. This allows the paper to advance one line while the stepper motor 11 is inactive. The reason that the motion of the hammers and the paper feed is synchronized with one another is to allow the maximum through-put or the maximum print line rate.

After the TA sector has passed the photocell 17, the apertures 10-1 of sector A will consecutively pass the photocell 17. These signals are shown in FIGS. 7*a, b, c* and *e*. In the manner previously described, 12 bit shift register 40 (FIG. 6) will be jammed to zero and it will begin to count downwardly from HP10 to HP1. It should be noted that the left to right signal (FIG. 7*e*) is no longer positive but is at ground potential. This signal will be applied to the inverter 37 where it reverts to the HIGH state. This HIGH signal in combination with the output of the differentiator 30 causes the AND gate 38 to be permissed and hence, the 12 bit shift register begins to count downwardly. In all other respects, the logic operates in the same manner as previously described. Accordingly, a second line is printed on the paper 22 (FIG. 1) when the barrel cam 13 travels in the right to left direction.

Figure 15:
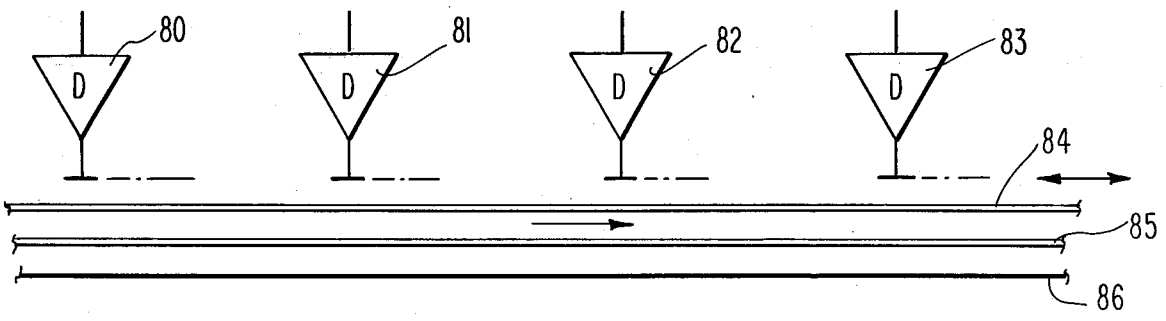
FIG. 15 is another embodiment of the invention wherein non-impact technology is utilized.

The time sharing hammer principles discussed in this invention may be applied equally well to other printer technologies such as the new non-impact technology. One such new non-impact technology is basically shown in FIG. 15 wherein the electrodes and drivers 80–83 are oriented opposite the band 84 having hollow characters etched on 0.250 inch centers, the paper 85 and the ribbon 86. The technology is based on the paper 85 being coated with a special dry particulate ink and the ribbon 86 being placed adjacent to the paper. When a shaped electric field is generated through the ribbon and paper, it causes the particulate ink to be transferred to the paper. If the electric field is in the shape of a character, that character's image will be formed on the paper, thus accomplishing printing without the customery impact.

In the manner previously discussed with respect to the impact printing described with respect to FIGS. 1–14, the electrodes 80–83 are also shared between more than one print column by being oscillated back and forth or time shared between a certain number of column positions.

The detailed action of the non-impact printer will be the same as that described with respect to the impact printer except that instead of a hammer being fired and physically impacting the paper, an electrode is pulsed that electrically attracts ink to produce printing.

What is claimed is:

1. A printer device having a single moving character band and a plurality of print hammers which are separated from each other across a line of print by a distance wherein each respective hammer is time shared with a plurality of print locations along said print line, the improvement comprising:

a. a barrel cam which is continuously rotated in a single direction on a shaft by a motor means;

b. follower means coupled to said barrel cam and the respective hammers;

c. a cam rotation of 180 degrees causing said follower means and each said print hammer to be linearly translated over said plurality of print locations for time sharing each respective hammer to record a line of print in a first direction;

d. the cam rotation of an additional 180° causing said follower means and each said hammer to be linearly translated in a reverse direction over said plurality of print locations for time sharing each respective hammer to record a line of print in a second direction;

e. each moving print hammer having a width dimension such that each time-shared hammer is in a position to print any character from said single moving band at a print location center before being translated to an adjacent print location center, and the width dimension of said moving hammers are approximately twice the separation of adjacent print location centers;

f. a disc means positioned on said shaft having a first and second group of indicia, one group of indicia indicating the particular column position of each time-shared print hammer in said first direction and, one group of indicia indicating the particular column position of each time-shared print hammer in said second direction.

* * * * *